US008840426B2

(12) United States Patent
Pepe

(10) Patent No.: US 8,840,426 B2
(45) Date of Patent: Sep. 23, 2014

(54) TELECOMMUNICATIONS JACK HAVING OFFSET STOP LATCHES AND PANEL INCLUDING THE SAME

(71) Applicant: Tyco Electronics Corporation, Berwyn, PA (US)

(72) Inventor: Paul John Pepe, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 20 days.

(21) Appl. No.: 13/720,541

(22) Filed: Dec. 19, 2012

(65) Prior Publication Data

US 2013/0164966 A1 Jun. 27, 2013

Related U.S. Application Data

(60) Provisional application No. 61/579,587, filed on Dec. 22, 2011.

(51) Int. Cl.
*H01R 24/00* (2011.01)

(52) U.S. Cl.
USPC ..... 439/540.1; 439/676; 439/717

(58) Field of Classification Search
USPC ..... 439/540.1, 541.5, 676, 717, 716
See application file for complete search history.

(56) References Cited

U.S. PATENT DOCUMENTS

| | | | | |
|---|---|---|---|---|
| 5,288,251 | A * | 2/1994 | Sumida | 439/701 |
| 6,079,996 | A | 6/2000 | Arnett | |
| 6,714,417 | B2 * | 3/2004 | Yu | 361/730 |
| 6,851,985 | B2 * | 2/2005 | Lafragette et al. | 439/701 |
| 6,953,362 | B2 | 10/2005 | Mössner et al. | |
| 7,025,621 | B2 | 4/2006 | Mössner et al. | |
| 7,187,766 | B2 | 3/2007 | Hammond, Jr. | |
| 7,270,563 | B2 | 9/2007 | Mossner et al. | |
| 7,311,550 | B2 | 12/2007 | Hammond, Jr. et al. | |
| 7,354,281 | B1 * | 4/2008 | Brodsky et al. | 439/78 |
| 7,381,098 | B2 | 6/2008 | Hammond, Jr. et al. | |
| 7,402,085 | B2 | 7/2008 | Hammond, Jr. et al. | |
| 7,442,053 | B2 * | 10/2008 | Brodsky et al. | 439/78 |
| 7,479,046 | B2 * | 1/2009 | Konno et al. | 439/717 |
| 7,549,891 | B2 | 6/2009 | Mössner et al. | |

(Continued)

FOREIGN PATENT DOCUMENTS

| | | |
|---|---|---|
| JP | 10-321307 | 12/1998 |
| JP | 11-195457 | 7/1999 |

OTHER PUBLICATIONS

International Search Report and Written Opinion for PCT/US2012/070294 mailed Apr. 19, 2013.

*Primary Examiner* — Gary Paumen
(74) *Attorney, Agent, or Firm* — Merchant & Gould P.C.

(57) ABSTRACT

A telecommunications jack and associated panel and method of construction are disclosed. The telecommunications jack is configured for use in a twisted pair system and includes a housing defining a port for receiving a plug, and a latching mechanism positioned to retain the housing in an opening of a face of a telecommunications panel. The telecommunications jack also includes a first stop latch positioned along the left side of the housing and a second stop latch positioned along the right side of the housing, the first and second stop latches vertically offset from each other and extending from the sides of the housing by a width, wherein the telecommunications jack is installable in an array of telecommunications jacks at a distance from a neighboring telecommunications jack of less than twice the width.

20 Claims, 9 Drawing Sheets

(56) References Cited

U.S. PATENT DOCUMENTS

| | | | | |
|---|---|---|---|---|
| 7,695,307 | B2 | 4/2010 | Mossner et al. | |
| 7,722,390 | B2 | 5/2010 | Debenedictis et al. | |
| 7,731,525 | B2 | 6/2010 | Hammond, Jr. et al. | |
| 7,787,615 | B2 | 8/2010 | Hammond, Jr. et al. | |
| 7,950,951 | B2 | 5/2011 | Mossner et al. | |
| 7,997,926 | B2 | 8/2011 | Hammond, Jr. et al. | |
| 8,073,136 | B2 | 12/2011 | Hammond, Jr. | |
| 8,151,457 | B2 | 4/2012 | Hammond, Jr. et al. | |
| 8,369,513 | B2 | 2/2013 | Hammond, Jr. | |
| 8,403,709 | B2 | 3/2013 | Hammond, Jr. et al. | |
| 2001/0039142 | A1* | 11/2001 | Maeda et al. | 439/540.1 |
| 2005/0186838 | A1 | 8/2005 | Debenedictis et al. | |
| 2005/0221678 | A1 | 10/2005 | Hammond, Jr. | |
| 2009/0004913 | A1 | 1/2009 | Caveney et al. | |
| 2011/0097942 | A1 | 4/2011 | Dooley et al. | |
| 2011/0318970 | A1 | 12/2011 | Hammond, Jr. et al. | |

* cited by examiner

TELECOMMUNICATIONS JACK HAVING OFFSET STOP LATCHES AND PANEL INCLUDING THE SAME

CROSS-REFERENCE TO RELATED APPLICATION

The present application claims the benefit of U.S. Provisional Patent Application Ser. No. 61/579,587, filed Dec. 22, 2011, which application is hereby incorporated by reference in its entirety.

TECHNICAL FIELD

The present application relates generally to telecommunications equipment useable in twisted pair systems. In particular, the present application relates to a telecommunications jack having offset stop latches, and a panel including the same.

BACKGROUND

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

One prevalent type of communication system uses twisted pairs of wires to transmit signals. In twisted pair systems, information such as video, audio and data are transmitted in the form of balanced signals over a pair of wires. The transmitted signal is defined by the voltage difference between the wires. In twisted pair systems, telecommunications equipment is typically interconnected using wiring and jack-based systems of a variety of formats. One such format includes an array of telecommunications jacks, such as RJ-45 jacks. These jacks can be included in a telecommunications panel or other telecommunications equipment.

Telecommunications jacks in a telecommunications panel are typically arranged in a closely-spaced array to promote density of those jacks. For example, telecommunications jacks can be constructed to snap fit into a face of a panel in a closely-spaced, linear arrangement. However, the density of telecommunications jacks is limited due to the spacing necessary to support each telecommunications jack within the panel.

FIGS. 1-3 illustrate an array 10 of telecommunication jacks 12 useable within a prior art telecommunications panel. As illustrated, each jack generally has a housing 14 with a front 16, rear 18, top 20, bottom 22, and left and right sides 24, 26, respectively, The housing 14 includes a port 28 on the front 16 and configured to receive a twisted pair plug, such as an RJ-45 plug. The housing 14 also includes a rear 18 that includes a plurality of insulation displacement connectors 30 useable for connecting twisted pair wires thereto, and which connect to contact springs 32 within the port.

As illustrated in FIGS. 1-3, each of the telecommunications jacks 12 includes features used to retain each jack within a panel. In the embodiment shown, the telecommunications jacks 12 each include a catch 34 on the bottom 22 and a retaining clip 36 on the top 20. The telecommunications jacks also include stop latches 38 positioned symmetrically on opposing sides 24, 26 of the housing 14.

In use, when a telecommunications jack 12 is inserted into a face of a telecommunications panel, that telecommunications panel will include an opening generally sized and shaped (e.g., rectangularly) to receive the telecommunications jack. An assembler of such a panel will insert a telecommunications jack 12 into the opening by positioning the catch 34 over a bottom edge of the opening, and pivoting the jack 12 upwards, thereby engaging the retaining clip 36 with a top edge of the opening. The stop latches 38 are positioned rearward of the catch 34, and brace against a rear side of the panel, limiting forward movement of the telecommunications jack (i.e., preventing the jack from falling forward out of the face of a telecommunications panel.

Although each telecommunications jack 12 is independently retained and closely spaced to adjacent jacks, the density with which such jacks can be installed in a telecommunications panel is limited in the horizontal direction. First, density is limited by the thickness of the stop latches 38. Secondly, because stop latches 38 on a telecommunications jack are positioned along sizes 24, 26 in a symmetrical configuration, the stop latches are typically placed adjacent one another when the total distance between two adjacent telecommunications jacks 12 can be, at a minimum, twice the width of one stop latch. Accordingly, density of telecommunications jacks in a telecommunications panel is substantially limited.

SUMMARY

In a first aspect, a telecommunications jack for use in a twisted pair system is disclosed. The telecommunications jack includes a housing defining a port for receiving a plug, the housing having a generally rectangular shape including a top, a bottom, and left and right sides. The telecommunications jack also includes a plurality of contact springs adapted to make electrical contact with the plug when the plug is inserted into the port of the housing and a plurality of wire termination contacts for terminating wires to the jack, as well as a latching mechanism positioned to retain the housing in an opening of a face of a telecommunications panel. The telecommunications jack includes a first stop latch positioned along the left side of the housing and a second stop latch positioned along the right side of the housing, the first and second stop latches vertically offset from each other and extending from the sides of the housing by a width, wherein the telecommunications jack is installable in an array of telecommunications jacks at a distance from a neighboring telecommunications jack of less than twice the width.

In a second aspect, an array of telecommunications jacks mountable into a face of a telecommunications panel is disclosed which includes first and second telecommunications jacks. Each of the first and second telecommunications jacks includes a housing defining a port for receiving a plug, the housing having a generally rectangular shape including a top, a bottom, and left and right sides. Each of the first and second telecommunications jacks also includes a plurality of contact springs adapted to make electrical contact with the plug when the plug is inserted into the port of the housing and a plurality of wire termination contacts for terminating wires to the jack. Each of the first and second telecommunications jacks further includes a latching mechanism positioned to retain the housing in an opening of a face of a telecommunications panel. Each of the first and second telecommunications jacks includes a first stop latch positioned along a left side of the housing and a second stop latch positioned along a right side of the housing, the first and second stop latches vertically offset from each other. When the first and second telecommunications jacks are mounted in a face of a telecommunications panel such that the left side of the first telecommunications jack faces the right side of the second telecommunications jack, the first stop latch of the first telecommunications jack and the second stop latch of the second telecommunications jack do not occupy the same vertical position between the first and second telecommunications jacks.

In a third aspect, a telecommunications panel includes a telecommunications jack and a panel face. The telecommunications jack includes a housing defining a port for receiving a plug, the housing having a generally rectangular shape including a top, a bottom, and left and right sides, as well as both a plurality of contact springs adapted to make electrical contact with the plug when the plug is inserted into the port of the housing and a plurality of wire termination contacts for terminating wires to the jack. The telecommunications jack also includes a latching mechanism positioned to retain the housing in an opening of a face of a telecommunications panel. The telecommunications jack further includes a first stop latch positioned along the left side of the housing and a second stop latch positioned along the right side of the housing, the first and second stop latches vertically offset from each other and extending from the sides of the housing by a width. The panel face includes a plurality of horizontally disposed jack openings, each jack opening sized to receive a housing of a telecommunications jack. The telecommunications jack is installable in an array of telecommunications jacks at a distance from a neighboring opening of less than twice the width.

In a fourth aspect, a method of installing a plurality of telecommunications jacks into a telecommunications panel includes inserting an upwardly-oriented telecommunications jack into an opening in a face of a telecommunications panel such that a catch on a bottom side of the telecommunications jack housing engages a bottom edge of the opening to prevent rearwards movement. The method also includes pivoting the telecommunications jack forward within the opening to engage a retaining clip on a top of the telecommunications jack housing. Forward movement of the telecommunications jack is limited by stop latches on opposing sides of the telecommunications jack housing, the stop latches on the opposing sides vertically offset from each other.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
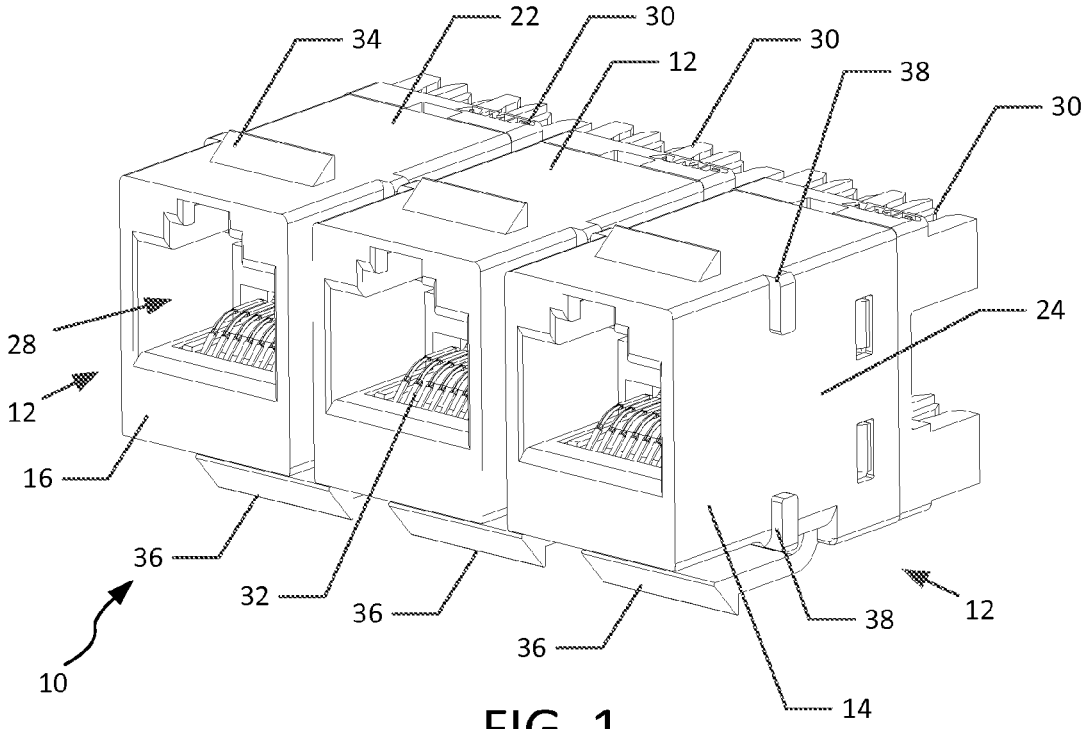
FIG. 1 (Prior Art)
FIG. 1 is a front perspective view of a linear arrangement of prior art telecommunications jacks.
Figure 2:
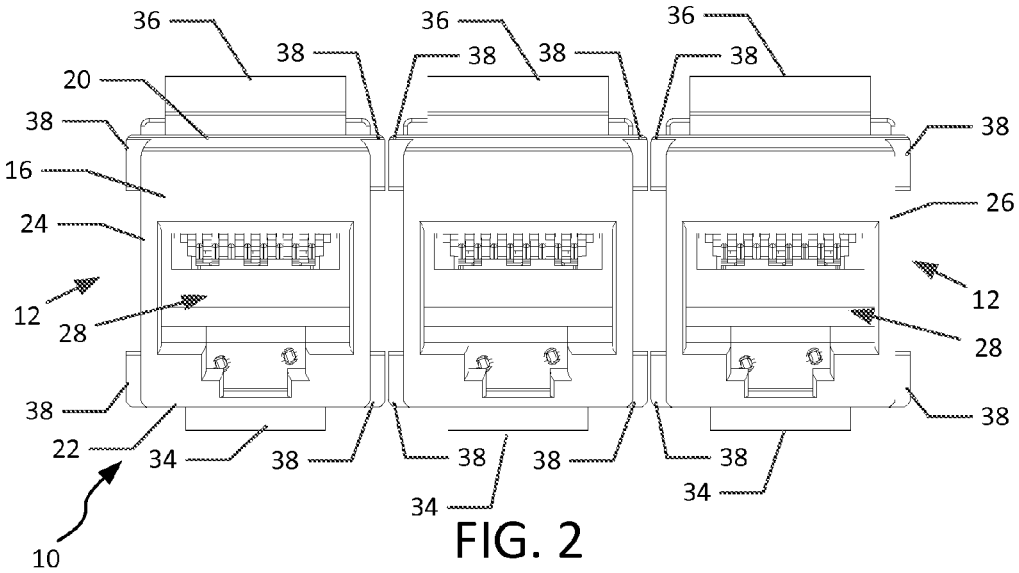
FIG. 2 (Prior Art)
FIG. 2 is a front plan view of the arrangement of prior art telecommunications jacks as illustrated in FIG. 1.
Figure 3:
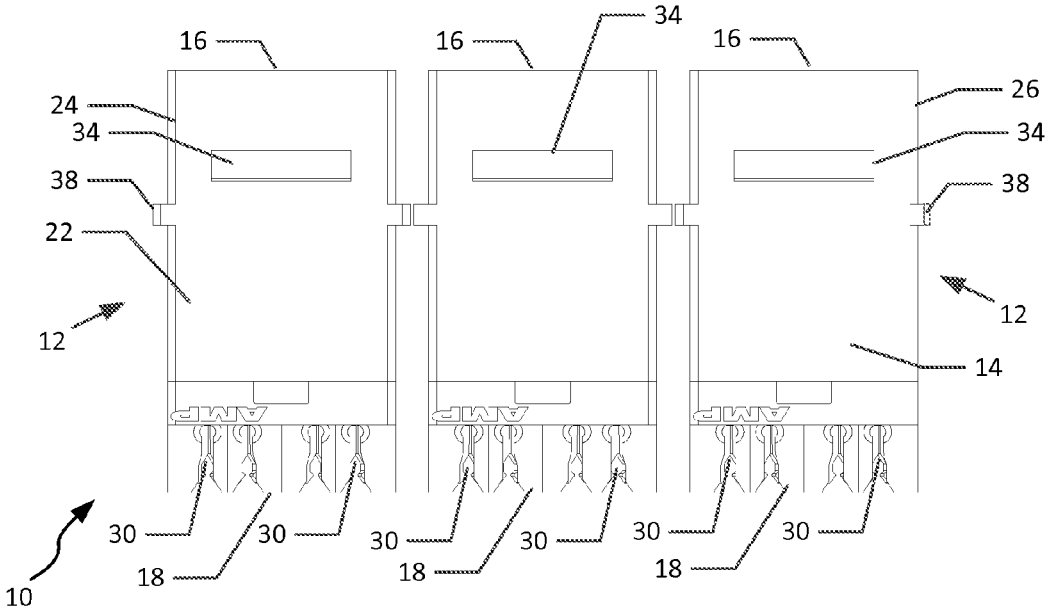
FIG. 3 (Prior Art)
FIG. 3 is a bottom plan view of the arrangement of prior art telecommunications jacks as illustrated in FIG. 1.
Figure 4:
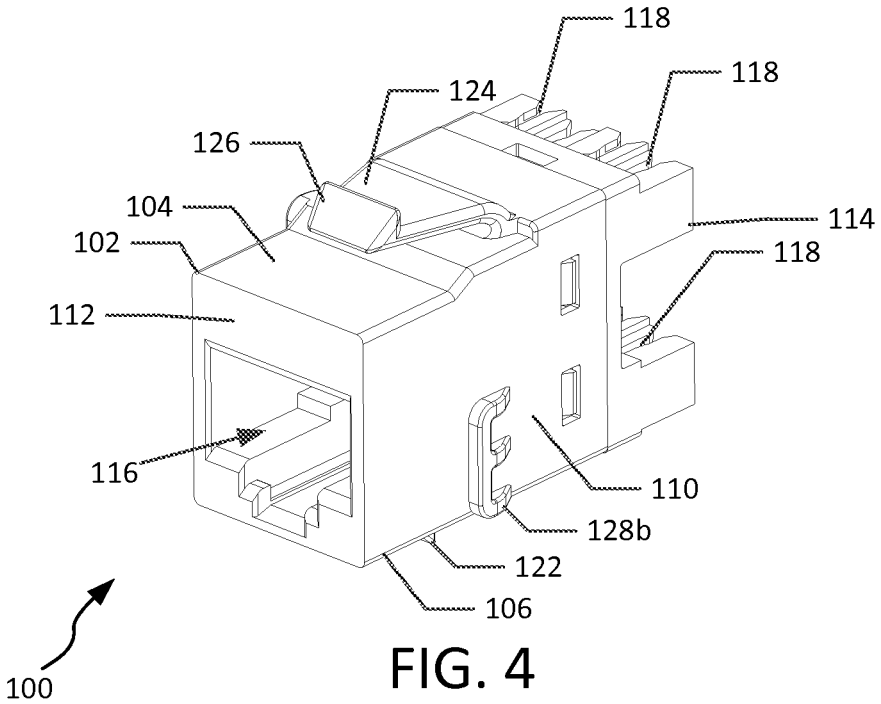
FIG. 4 is a front perspective view of a telecommunications jack including offset stop latches, showing top and right sides of a housing of the jack, according to a possible embodiment of the present disclosure.
Figure 5:
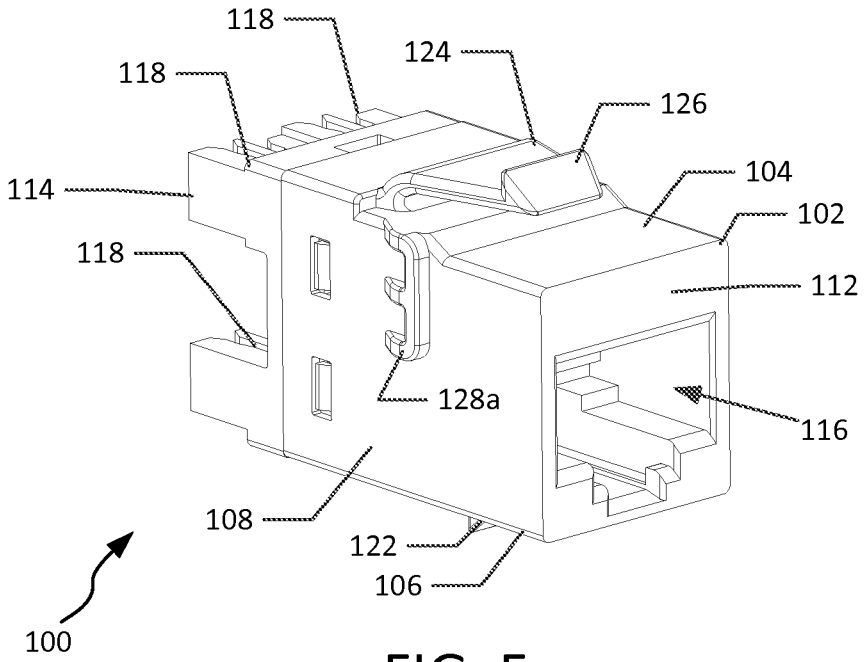
FIG. 5 is a reversed front perspective view of the telecommunications jack of FIG. 4, showing top and left sides of the housing.
Figure 6:
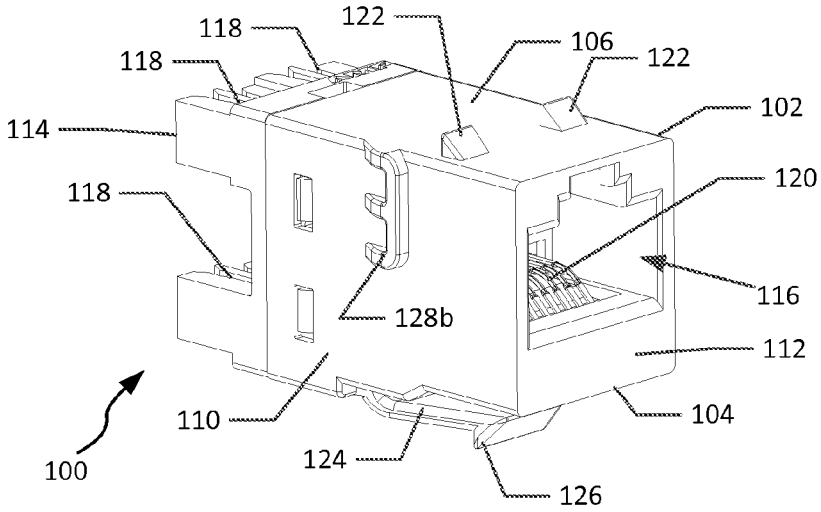
FIG. 6 is a front perspective view of the telecommunications jack of FIG. 4, showing a bottom side and a right side of the housing
Figure 7:
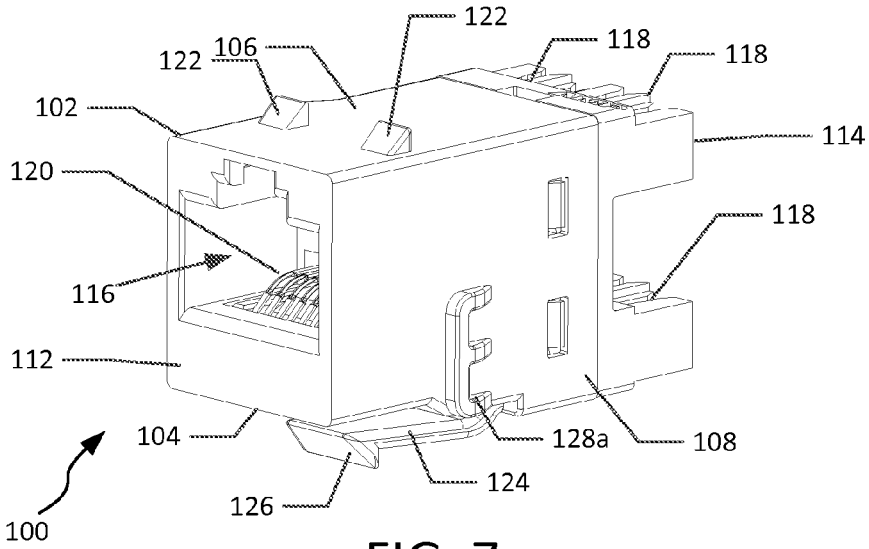
FIG. 7 is a front perspective view of the telecommunications jack of FIG. 4, showing a bottom side and a left side of the housing.
Figure 8:
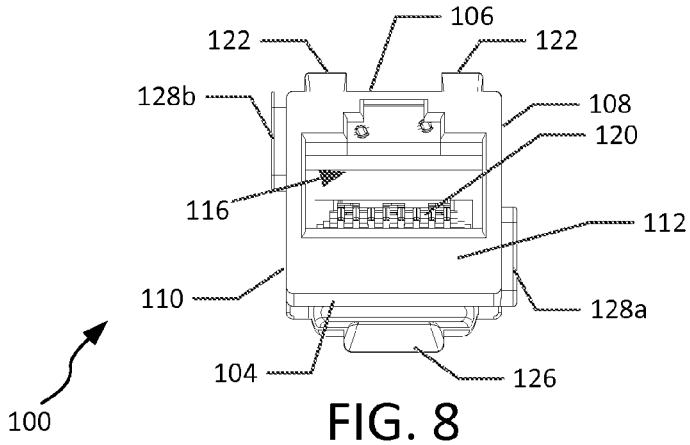
FIG. 8 is a front plan view of the telecommunications jack of FIG. 4.
Figure 9:
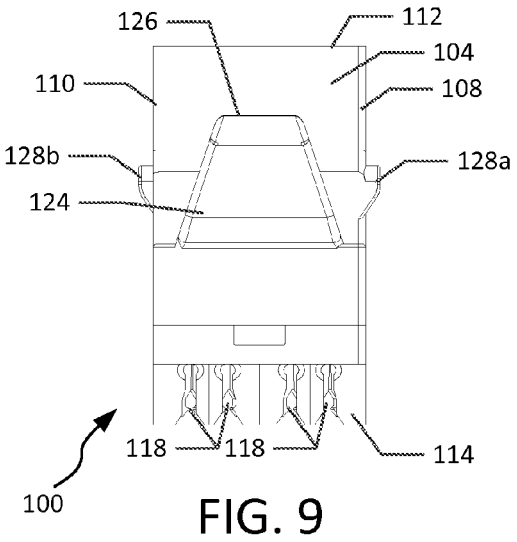
FIG. 9 is a top plan view of the telecommunications jack of FIG. 4.
Figure 10:
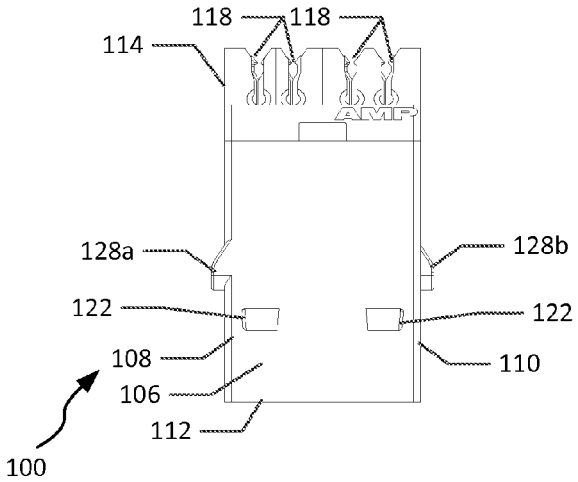
FIG. 10 is a bottom plan view of the telecommunications jack of FIG. 4.
Figure 11:
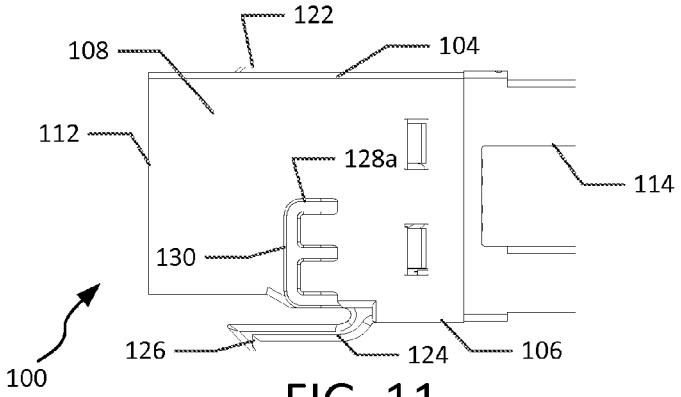
FIG. 11 is a left side plan view of the telecommunications jack of FIG. 4.
Figure 12:
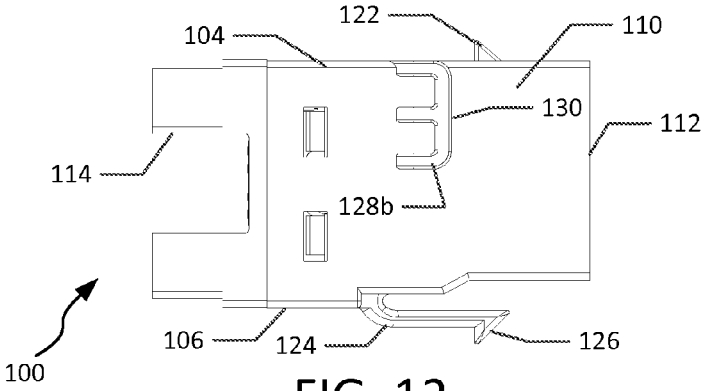
FIG. 12 is a right side plan view of the telecommunications jack of FIG. 4.
Figure 13:
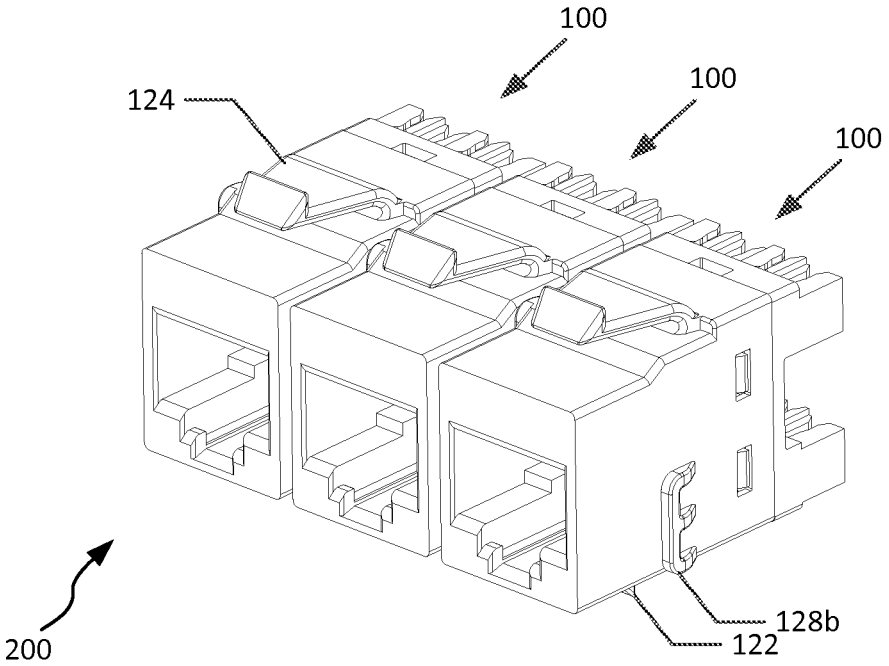
FIG. 13 is a front perspective view of a linear arrangement of telecommunications jacks including offset stop latches, according to a possible embodiment of the present disclosure.
Figure 14:
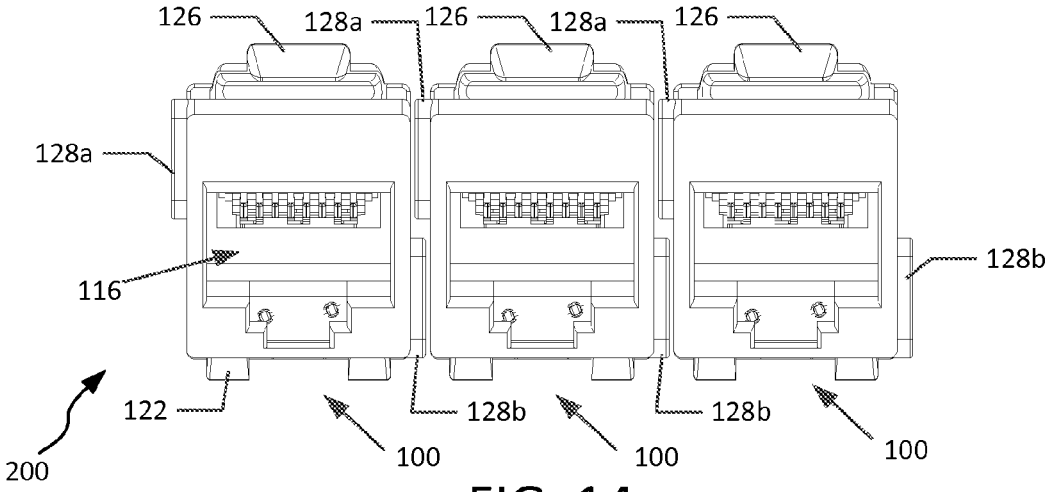
FIG. 14 is a front plan view of the arrangement of telecommunications jacks as illustrated in FIG. 13.
Figure 15:
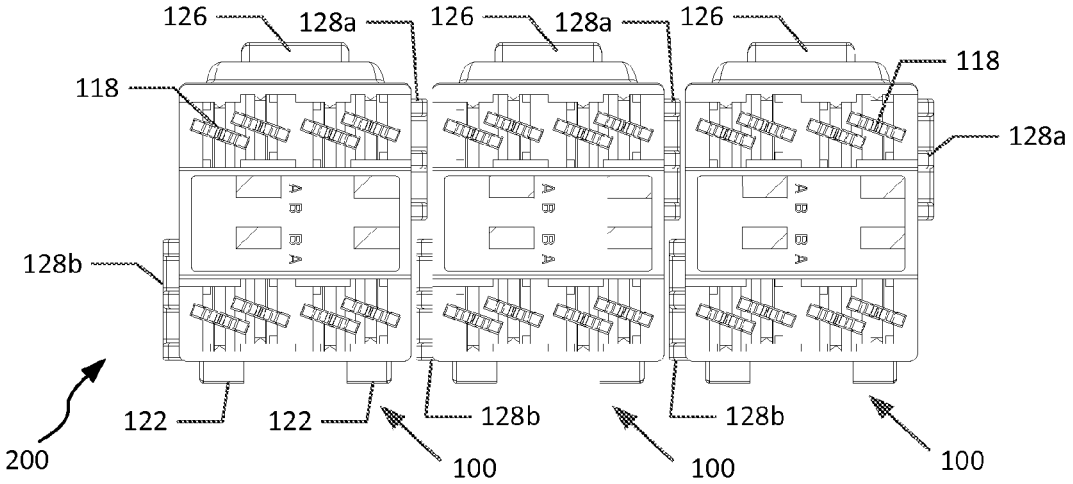
FIG. 15 is a rear plan view of the arrangement of telecommunications jacks as illustrated in FIG. 13.

In general, the present disclosure relates to a telecommunications jack, array of jacks, and an associated telecommunications panel including one or more telecommunications jacks configured to include retaining features that are positioned and sized to improve linear density of such jacks when used in an array. In some embodiments, the telecommunications jacks disclosed herein use offset stop latches positioned along the sides of a housing of a jack, such that the stop latches of neighboring jacks do not abut one another. This allows for improved density as compared to symmetrically-arranged stop latches, such as those disclosed in FIGS. 1-3.

Referring now to FIGS. 4-12, an example telecommunications jack 100 is disclosed. The telecommunications jack 100 includes a housing 102. As shown, the housing is rectangular, and includes a top 104, bottom 106, left and right sides 108, 110, respectively, as well as a front 112 and a rear 114. Although depicted in FIGS. 4-12 as rectangular, the housing 102 can be any of a variety of sizes or shapes.

In the embodiment shown, the housing includes a port 116 on the front 112 for receiving a plug for twisted pair wiring. As shown, the port 116 can be sized to receive an RJ-45 plug; in alternative embodiments, the telecommunications jack 100 can be configured to receive other sizes or formats of twisted pair connectors. On the rear 114, a plurality of insulation displacement connectors 118 are provided. The insulation displacement connectors 118 provide a location at which twisted pair wiring within a telecommunications panel can be connected to the telecommunications jack 100. In the telecommunications jack 100, each of the insulation displacement connectors 118 is electrically connected within the housing 102 to contact springs 120 within the port 116, which are configured to electrically connect to a plug when inserted into the port 116. In the embodiment shown, eight insulation displacement connectors 118 (and associated contact springs 120) are shown; in other embodiments implementing other types of telecommunications jacks, other numbers of insulation displacement connectors could be included.

Figure 17:
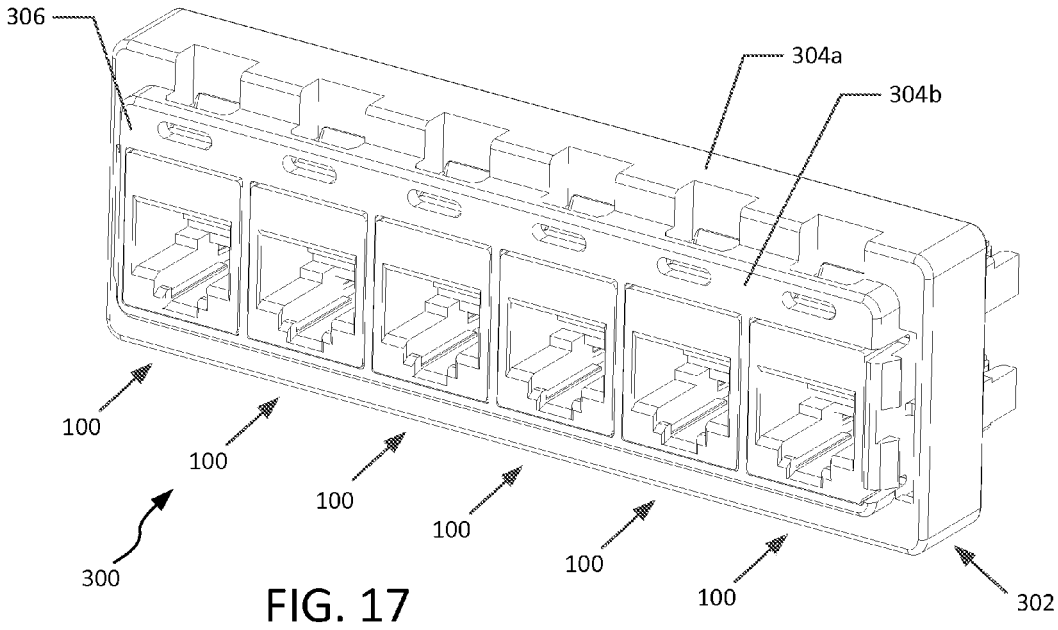
FIG. 17 is a front perspective view of a telecommunications panel assembly including an array of telecommunications jacks.
Figure 18:
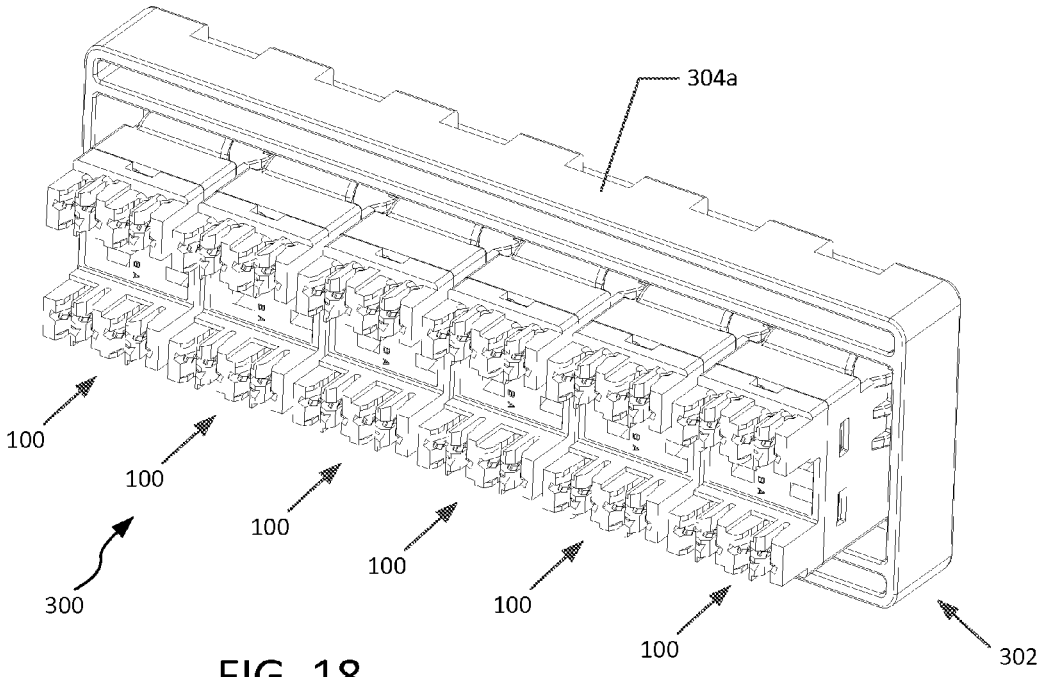
FIG. 18 is a rear perspective view of the telecommunications panel assembly illustrated in FIG. 17.
Figure 19:
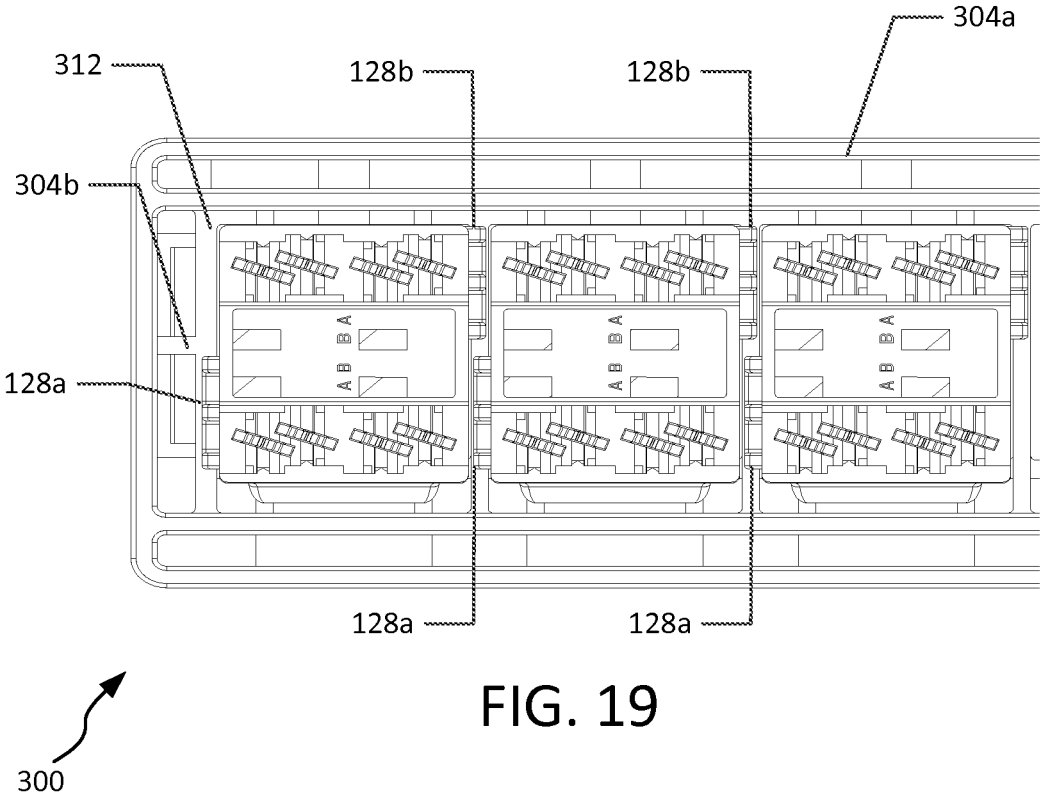
FIG. 19 is a rear plan view of a section of the telecommunications panel assembly illustrated in FIG. 17.
Figure 20:
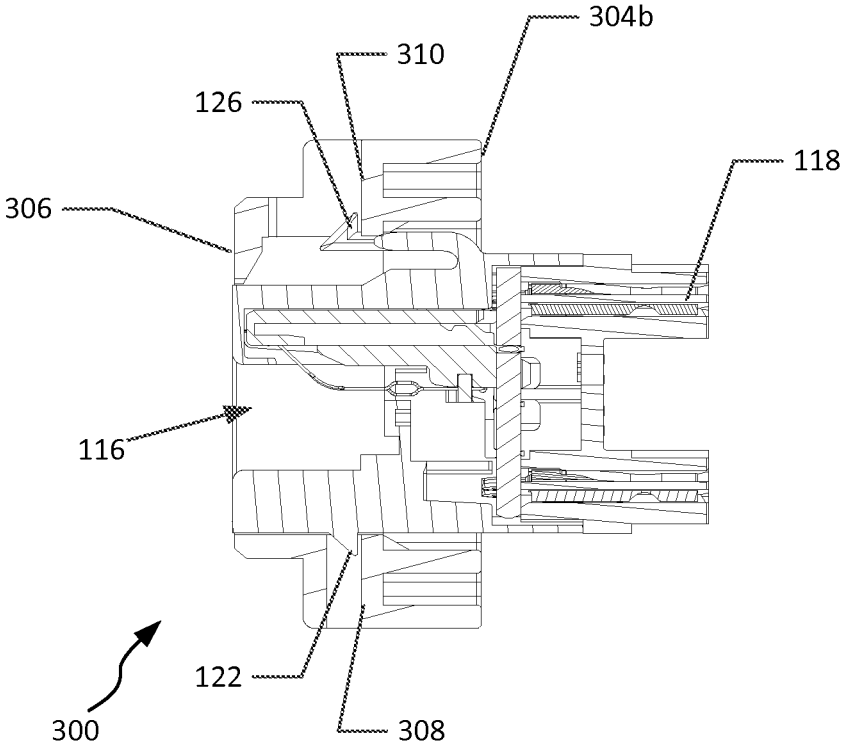
FIG. 20 is a side cross-sectional view of the telecommunications panel assembly of FIG. 17, bisecting a telecommunications jack.

The housing 102 includes a number of features configured for retaining the telecommunications jack 100 in an opening in a face of a telecommunications panel (e.g., as illustrated in FIGS. 17-19, discussed below). In the embodiment shown, the housing 102 includes a latching mechanism used to retain the telecommunications jack in an opening of a panel face, such as may be located in a telecommunications panel. The latching mechanism includes a catch 122 and a retaining clip 124. The catch 122 is positioned along the bottom 106 of the housing 102, and is generally a fixed position protrusion. In use, the catch 122 is positioned in front of at least a portion of a panel face, to prevent the telecommunications jack 100 from sliding back into an interior of the panel when a plug is inserted into the port 116. In the embodiment shown, the catch 122 includes a pair of protruding wedge-shaped tabs; other configurations are possible as well. Additionally, the catch 122 is shown as being positioned forward of a midpoint between the front 112 and rear 114 of the housing 102. However, in alternative embodiments, alternative positions for the catch 122 could be used as well.

The retaining clip 124 is positioned along an opposite side from the catch 122, in the embodiment of FIGS. 4-12 represented as the top 104. The retaining clip is generally a resiliently compressible plastic or metal clip formation that protrudes from the housing 102, and which can be compressed toward the top 104 of the housing 102. The retaining clip 124 includes a wedge-shaped retention tab 126 generally aligned with the catch 122. When the telecommunications jack is inserted into an opening of a panel face, the telecommunications jack can be tilted to hook the catch 122 onto a portion of the panel face. The telecommunications jack 100 can then be pivoted forward into the opening. The retaining clip will engage a top edge of the opening and be depressed downward toward the top 104 due to engagement of the retention tab 126 with a top edge of the opening until the jack is approximately level, at which point the clip will have passed through the opening and will spring back to the position as shown, with the retention tab 126 also preventing rearward movement of the telecommunications jack 100 outwardly through a panel opening. Further details regarding mounting a telecommunications jack in a panel are discussed below in connection with FIGS. 17-20.

Although the catch 122 and retaining clip 124 prevent the telecommunications jack 100 from receding backwards through a panel face, these features on the housing 102 do not prevent the telecommunications jack from continuing to move forward through an opening in a panel face. Accordingly, stop latches 128*a-b* are positioned on left and right sides 108, 110, respectively, and each include a front surface 130 configured to engage the rear surface of a panel face (as illustrated in FIGS. 17-19). The stop latches 128*a-b* are aligned rearwardly of the location of the catch 122 and retention tab 126 (i.e., at a greater distance from the front 112 of the jack 100), such that the stop latches remain behind the panel face when the telecommunications jack 100 is inserted into a panel face from a rear side.

In the embodiment shown, a first stop latch 128*a* is positioned along and protrudes from a left side 108 of the housing 102, and a second stop latch is positioned along and protrudes from a right side 110 of the housing. In contrast to the symmetrically-arranged stop latches in FIGS. 1-3, in the embodiment shown the stop latches are vertically offset from one another, such that the two stop latches are not both present in any horizontal cross-sectional plane of the telecommunications jack.

In the embodiment shown, the first stop latch 128*a* extends from the left side 108 a first width, and the second stop latch 128*b* extends from the right side 108 a second width. In various embodiments, the first and second widths can be different; however, in the embodiment shown, the first and second widths are approximately the same. Generally the first and second widths are minimized to minimize the distance between housings of adjacent telecommunications jacks (as seen in FIGS. 13-19); however, the stop latches 128*a-b* are generally of a sufficient width to prevent them fitting through an opening in a panel face, such that a telecommunications jack 100 would be able to be pulled out of a panel from the front face (e.g., by pulling on a plug inserted into the jack 100).

In the embodiment shown, the first stop latch 128*a* resides in a vertical position extending from a top edge of the left side 108 (i.e., at or near the top 104) to approximately a midpoint of the housing toward the bottom 106. Complementarily, the second stop latch 128*b* resides in a vertical position extending from a bottom edge of the right side 110 (i.e., at or near the bottom 106) to approximately a midpoint of the housing toward the top 104. Notably, the first stop latch 128*a* and second stop latch 128*b* do not extend such that both reach the midpoint or extend past the midpoint, which would cause both stop latches to occupy the same horizontal cross-sectional plane of the telecommunications jack. Accordingly, one or both stop latches 128*a-b* may have a length of less than half the height of the housing 102.

Additionally, as discussed above, the first and second stop latches 128*a-b* include a front surface 130 positioned to contact a rear of a panel face; however, the size and shape of the stop latches may vary. In the embodiment shown, each of the stop latches is generally "E" shaped, having portions that extend toward a rear 114 of the housing 102, and tapering toward the housing in the direction of the rear. However, other shapes could be used as well.

Additionally, although in the embodiment shown two stop latches are provided, in alternative configurations, the stop latch configuration could vary. For example the first stop latch 128*a* could occupy more or less of the vertical position, or could be positioned generally near the bottom 106 along the left side 108; in such an embodiment, the second stop latch 128*b* would be longer or shorter as well, or repositioned such that it remained out of the same horizontal cross-sectional plane as the first stop latch 128*a*. Additionally, in some embodiments, more than one such stop latch can be included on each side of the housing 102; in such embodiments, each of the stop latches on one side of the housing will remain out of the same horizontal cross-sectional plane as any latch on an opposing side of the housing. By ensuring that no left side and right side stop latch is in the same horizontal cross-sectional plane as another stop latch on an opposing side, it is possible to ensure that when two identical telecommunications jacks are positioned side by side, it is possible to maintain a reduced distance between those jacks, such that the distance between the jacks can be less than the combined thicknesses of the first and second stop latches 128*a-b*.

Figure 16:
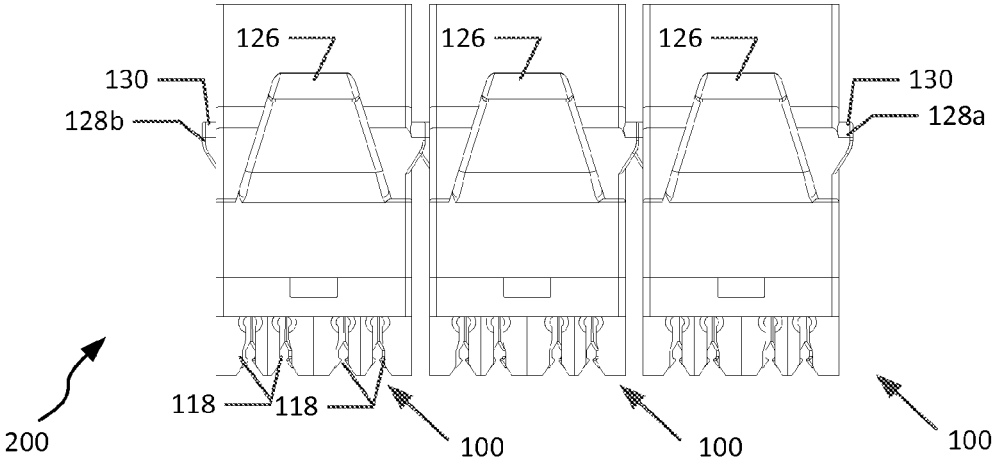
FIG. 16 is a top plan view of the arrangement of telecommunications jacks as illustrated in FIG. 13.

Referring now to FIGS. 13-16, an array 200 of telecommunications jacks 100, such as those discussed above in connection with FIGS. 4-12, is disclosed. In this arrangement, interrelationships between the stop latches 128 of the telecommunications jacks 100 are illustrated. Generally, as illustrated in FIGS. 13-16, and in contrast to the arrangement illustrated in FIGS. 1-3, a distance between housings 102 of two telecommunications jacks is, at a minimum, equivalent to a maximum thickness of a stop latch 128 included on the housing of one of the telecommunications jacks. In contrast, in prior art systems, such as the one illustrated in FIGS. 1-3, a minimum distance between two telecommunications jacks 100 cannot be less than the combined thickness of the first and second stop latches illustrated in that drawing, since that jack is left-right symmetrical and stop latches on opposing sides reside within the same horizontal cross-sectional plane. It is noted that, as shown in FIG. 16, the stop latches 128*a-b* generally remain aligned at a common distance between the front 112 and rear 114, and in particular such that the front surfaces 130 of the stop latches remain aligned.

Referring to FIGS. 17-19 a portion of a telecommunications panel 300 is shown. The portion illustrated includes a face 302 including a plurality of telecommunications jacks 100 mounted thereto. As shown, the plurality of telecommunications jacks 100 are mounted in an array, such as array 200 of FIGS. 13-16. As shown the face 302 of the panel, or panel face, can include one or more component parts, such as panel mounting face 304*a* and jack mounting face 304*b*, cooperating to provide a structure sized to fit onto a front or rear of a panel, and which also includes a plurality of openings into which the telecommunications jacks 100 can be received.

As shown in FIGS. 17-19, when the telecommunications jacks 100 are inserted into the face 302, a front 112 of each telecommunications jack 100 is approximately aligned with a front surface 306 of the face 302. As such, an interior ledge can be used for engaging the catch 122 and the retaining clip 124 of a telecommunications jack 100. As mentioned above, when a telecommunications jack is inserted into an opening in a panel face 302, the catch 122 can engage a lower internal ledge 308 and the retaining clip 124 can engage an upper internal ledge 310 (e.g., as shown in the cross-sectional view provided in FIG. 20). When the jack 100 is inserted into the face 302 (e.g., by engaging the catch 122 and pivoting the retaining clip 124 forward into the opening. The stop latches remain behind and engage with a rear surface 312 of the face.

Although in the embodiment shown the telecommunications jacks and jack arrays are discussed as included within a telecommunications panel, it is understood that the jacks and jack arrays can be included within other types of equipment, such as a wall outlet or other telecommunications system. Generally, advantages of the telecommunications jacks disclosed herein are more apparent in that they are useable in higher-density linear arrays of jacks; however, use of such jacks are not so limited. Additionally, it is understood that the telecommunications jacks as discussed herein can be constructed from any of a variety of conventional materials, such as plastics, metals, or a combination thereof.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A telecommunications jack for use in a twisted pair system, the telecommunications jack comprising:

a housing defining a port for receiving a plug, the housing having a generally rectangular shape including a top, a bottom, and left and right sides;

a plurality of contact springs adapted to make electrical contact with the plug when the plug is inserted into the port of the housing;

a plurality of wire termination contacts for terminating wires to the jack;

a latching mechanism positioned to retain the housing in an opening of a face of a telecommunications panel; and a first stop latch positioned along the left side of the housing and a second stop latch positioned along the right side of the housing, the first and second stop latches vertically offset from each other and extending from the sides of the housing by a width, wherein the telecommunications jack is installable in an array of telecommunications jacks at a distance from a neighboring telecommunications jack of less than twice the width.

2. The telecommunications jack of claim 1, wherein the latching mechanism includes a catch along the bottom of the housing.

3. The telecommunications jack of claim 1, wherein the latching mechanism includes a retaining clip positioned along a top of the housing.

4. The telecommunications jack of claim 3, wherein the catch is located at a first distance from a front of the housing.

5. The telecommunications jack of claim 4, wherein the first and second stop latches are positioned at a second distance from the front of the housing, the second distance greater than the first distance.

6. The telecommunications jack of claim 5, wherein the second distance is greater than the first distance by at least a thickness of an engagement portion of a face of a telecommunications panel.

7. The telecommunications jack of claim 1, wherein the first and second stop latches on left and right sides of the housing form a complementary shape such that no horizontal plane exists in which stop latches are present on both sides of the housing.

8. The telecommunications jack of claim 1, wherein the first stop latch extends from a top edge of the left side of the housing toward the bottom a distance less than half a height of the housing, and wherein the second stop latch extends from a bottom edge of the right side of the housing toward the top a distance less than half a height of the housing.

9. The telecommunications jack of claim 1, wherein the first and second stop latches include a generally flat front surface positioned to engage a rear surface of a face of a telecommunications panel.

10. The telecommunications jack of claim 1, wherein the port is configured to receive an RJ-45 plug.

11. An array of telecommunications jacks mountable into a face of a telecommunications panel, the array of telecommunications jacks comprising:

first and second telecommunications jacks each comprising:

a housing defining a port for receiving a plug, the housing having a generally rectangular shape including a top, a bottom, and left and right sides;

a plurality of contact springs adapted to make electrical contact with the plug when the plug is inserted into the port of the housing;

a plurality of wire termination contacts for terminating wires to the jack;

a latching mechanism positioned to retain the housing in an opening of a face of a telecommunications panel; and a first stop latch positioned along a left side of the housing and a second stop latch positioned along a right side of the housing, the first and second stop latches vertically offset from each other;

wherein, when the first and second telecommunications jacks are mounted in a face of a telecommunications panel such that the left side of the first telecommunications jack faces the right side of the second telecommunications jack, the first stop latch of the first telecommunications jack and the second stop latch of the second telecommunications jack do not occupy the same vertical position between the first and second telecommunications jacks.

12. The array of telecommunications jacks of claim 11, wherein the first stop latch of the first telecommunications jack extends outwardly from the left side of the housing of the first telecommunications jack at a first distance and the second stop latch of the second telecommunications jack extends outwardly from the right side of the housing of the second telecommunications jack at a second distance, and wherein the first and second telecommunications jacks are capable of being positioned such that a distance between the housings of the first and second telecommunications jacks is less than the combined first and second distances.

13. The array of telecommunication jacks of claim 11, wherein the first stop latch of the first telecommunications jack extends from a top edge of the left side of the housing of the first telecommunications jack toward the bottom a distance less than half a height of the housing of the first telecommunications jack, and wherein the second stop latch of the second telecommunications jack extends from a bottom edge of the right side of the housing of the second telecommunications jack toward the top a distance less than half a height of the housing of the second telecommunications jack.

14. A telecommunications panel comprising:

a telecommunications jack comprising:

a housing defining a port for receiving a plug, the housing having a generally rectangular shape including a top, a bottom, and left and right sides;

a plurality of contact springs adapted to make electrical contact with the plug when the plug is inserted into the port of the housing;

a plurality of wire termination contacts for terminating wires to the jack;

a latching mechanism positioned to retain the housing in an opening of a face of a telecommunications panel; and a first stop latch positioned along the left side of the housing and a second stop latch positioned along the right side of the housing, the first and second stop latches vertically offset from each other and extending from the sides of the housing by a width; and a panel face including a plurality of horizontally disposed jack openings, each jack opening sized to receive a housing;

wherein the telecommunications jack is installable in an array of telecommunications jacks at a distance from a neighboring opening of less than twice the width.

15. The telecommunications panel of claim 14, wherein the port is configured to receive an RJ-45 plug.

16. The telecommunications panel of claim 14, wherein the latching mechanism of the telecommunications jack includes a catch along the bottom of the housing and a retaining clip positioned along a top of the housing.

17. The telecommunications panel of claim 16, wherein the catch is located at a first distance from a front of the housing and the first and second stop latches are positioned at a second distance from the front of the housing, the second distance greater than the first distance.

18. The telecommunications panel of claim 17, wherein the second distance is greater than the first distance by at least a thickness of an engagement portion of the panel face.

19. A method of installing a plurality of telecommunications jacks into a telecommunications panel, the method comprising:

inserting an upwardly-oriented telecommunications jack into an opening in a face of a telecommunications panel such that a catch on a bottom side of the telecommunications jack housing engages a bottom edge of the opening to prevent rearwards movement; and pivoting the telecommunications jack forward within the opening to engage a retaining clip on a top of the telecommunications jack housing;

wherein forward movement of the telecommunications jack is limited by stop latches on opposing sides of the telecommunications jack housing, the stop latches on the opposing sides vertically offset from each other.

20. The method of claim 19, wherein the stop latches on opposing sides of the telecommunications jack housing form a complementary shape such that no horizontal plane exists in which stop latches are present on both sides of the housing.

* * * * *